US006478396B1

(12) United States Patent
Schloeman et al.

(10) Patent No.: US 6,478,396 B1
(45) Date of Patent: Nov. 12, 2002

(54) PROGRAMMABLE NOZZLE FIRING ORDER FOR PRINTHEAD ASSEMBLY

(75) Inventors: Dennis J. Schloeman, Corvallis, OR (US); Jeffery S. Beck, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/798,330

(22) Filed: Mar. 2, 2001

(51) Int. Cl.[7] ..... B41J 29/38
(52) U.S. Cl. ..... 347/12; 347/9; 347/13
(58) Field of Search ..... 347/9–13, 42, 347/62, 19

(56) References Cited

U.S. PATENT DOCUMENTS

| | | | | |
|---|---|---|---|---|
| 4,463,359 A | | 7/1984 | Ayata et al. | 346/1.1 |
| 4,595,935 A | | 6/1986 | Brooks et al. | 346/76 PH |
| 4,695,853 A | | 9/1987 | Hackleman et al. | 346/140 R |
| 4,695,854 A | | 9/1987 | Cruz-Uribe | 346/140 R |
| 4,719,477 A | | 1/1988 | Hess | 346/140 R |
| 4,764,659 A | | 8/1988 | Minami et al. | 219/216 |
| 4,982,199 A | | 1/1991 | Dunn | 346/1.1 |
| 4,999,650 A | | 3/1991 | Braun | 346/140 R |
| 5,016,023 A | | 5/1991 | Chan et al. | 346/1.1 |
| 5,030,971 A | | 7/1991 | Drake et al. | 346/140 R |
| 5,049,898 A | | 9/1991 | Arthur et al. | 346/1.1 |
| 5,103,246 A | | 4/1992 | Dunn | 346/140 R |
| 5,327,165 A | | 7/1994 | Elliott | 346/76 PH |
| 5,363,134 A | | 11/1994 | Barbehenn et al. | 347/49 |
| 5,365,312 A | | 11/1994 | Hillmann et al. | 355/206 |
| 5,371,530 A | | 12/1994 | Hawkins et al. | 347/9 |
| 5,541,629 A | | 7/1996 | Saunders et al. | 347/12 |
| 5,604,513 A | | 2/1997 | Takahashi et al. | 345/153 |
| 5,610,635 A | | 3/1997 | Murray et al. | 347/7 |
| 5,646,660 A | | 7/1997 | Murray | 347/59 |
| 5,648,804 A | | 7/1997 | Keefe et al. | 347/47 |
| 5,742,305 A | * | 4/1998 | Hackleman | 347/42 |
| 5,815,172 A | | 9/1998 | Moh | 347/14 |
| 5,815,180 A | | 9/1998 | Barbour et al. | 347/59 |
| 5,886,718 A | | 3/1999 | Johnson et al. | 347/85 |
| 5,946,012 A | | 8/1999 | Courian et al. | 347/63 |
| 6,091,891 A | | 7/2000 | Overall et al. | 395/112 |
| 6,109,716 A | | 8/2000 | Takahashi | 347/11 |
| 6,126,261 A | | 10/2000 | Yamanaka | 347/12 |
| 6,178,009 B1 | | 1/2001 | Yamada et al. | 358/1.9 |
| 6,193,345 B1 | | 2/2001 | Feinn et al. | 347/12 |
| 6,273,539 B1 | * | 8/2001 | Suzuki | 347/12 |

FOREIGN PATENT DOCUMENTS

| | | | |
|---|---|---|---|
| EP | 0547921 A2 | 6/1993 | B41J/2/175 |
| JP | 07242004 | 3/1994 | B41J/2/30 |
| JP | 08127140 | 10/1994 | B41J/2/30 |

* cited by examiner

*Primary Examiner*—John Barlow
*Assistant Examiner*—An H. Do

(57) ABSTRACT

A printhead assembly includes at least one printhead having a group of nozzles, a group of firing resisters corresponding to the group of nozzles, a programmable nozzle firing order controller configured to provide address generator control signals, and a nozzle address generator configured to respond to the address generator control signals to provide a nozzle address. The nozzle address controls a sequence of which firing resister has electrical current pass through it at a given time to thereby control a firing order of the nozzles.

25 Claims, 6 Drawing Sheets

PROGRAMMABLE NOZZLE FIRING ORDER FOR PRINTHEAD ASSEMBLY

CROSS-REFERENCE TO RELATED APPLICATIONS

This Non-Provisional Patent Application is related to commonly assigned U.S. patent application Ser. No. 09/253,411, filed on Feb. 19, 1999, entitled "A HIGH PERFORMANCE PRINTING SYSTEM AND PROTOCOL," and which is herein incorporated by reference.

THE FIELD OF THE INVENTION

The present invention relates generally to inkjet printheads, and more particularly to controlling nozzle firing order in inkjet printheads.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

Typically, the printhead ejects the ink drops through the nozzles by rapidly heating a small volume of ink located in vaporization chambers with small electric heaters, such as thin film resisters. Heating the ink causes the ink to vaporize and be ejected from the nozzles. Typically, for one dot of ink, a remote printhead controller typically located as part of the processing electronics of a printer, controls activation of an electrical current from a power supply external to the printhead. The electrical current is passed through a selected thin film resister to heat the ink in a corresponding selected vaporization chamber.

In one type of printhead, switching devices, such as field effect transistors (FETs), are coupled to each thin film resistor to control the application of the electrical current through the selected thin film resistors. In one printhead arrangement, the resistors are grouped together into primitives, with a single power lead providing power to the source or drain of each corresponding FET for each resistor in a primitive. Each FET in a primitive has a separately energizable address lead coupled to its gate, with each address lead shared by multiple primitives. In a typical printing operation, the address leads are controlled so that only a single resistor in a primitive is activated at a given time.

In one arrangement, the address lead coupled to the gate of each FET is controlled by a combination of nozzle data, nozzle addresses, and a fire pulse. The nozzle data is typically provided by the electronic controller of the printer and represents the actual data to be printed. The fire pulse controls the timing of the activation of the electrical current through the selected resistor. Typical conventional inkjet printing systems employ the electronic controller to control the timing related to the fire pulse. The nozzle address is cycled through all nozzle addresses to control the nozzle firing order so that all nozzles can be fired, but only a single nozzle in a primitive is fired at a given time.

One type of printhead includes an address generator and a hard-coded address decoder at each nozzle for controlling nozzle firing order. In this type of printhead, the nozzle firing sequence can only be modified by changing appropriate metal layers on the printhead die. Thus, if a new nozzle firing order is desired in this type of printhead, the set nozzle firing sequence is modified by changing one or more masks to thereby change the metal layers that determine the nozzle firing sequence.

For reasons stated above and for other reasons presented in greater detail in the Description of the Preferred Embodiments section of the present specification, an inkjet printhead is desired which has a programmable nozzle firing order.

SUMMARY OF THE INVENTION

One aspect of the present invention provides a printhead including a group of nozzles and a group of firing resisters corresponding to the group of nozzles. The printhead includes a programmable nozzle firing order controller configured to provide address generator control signals. The printhead includes a nozzle address generator configured to respond to the address generator control signals to provide a nozzle address. The nozzle address controls a sequence of which firing resister has electrical current pass through it at a given time to thereby control a firing order of the nozzles.

In one embodiment, the programmable nozzle firing order controller includes a right scan starting address register holding a right scan starting address value representing a starting value for the nozzle address generator for printing in a right scan direction. In one embodiment, the programmable nozzle firing order controller also includes a left scan starting address register holding a left scan starting address value representing a starting value for the nozzle address generator for printing in a left scan direction. In one embodiment, the scan left and scan right starting addresses are stored in a shared starting address register, which is re-written with each change of scanning direction.

In one embodiment, the programmable nozzle firing order controller includes a control register holding control bits to control the nozzle firing order sequence provided by the nozzle address generator after a given scan right or left starting address. In one embodiment, the control register has a direction field representing a direction value to indicate to the address generator a scan direction of the inkjet printhead. The nozzle address generator responds to the direction value to either count up or count down based on the direction value. In one embodiment, the control register has an address sequence field representing an address sequence value to control a sequence in which the nozzle address generator counts up or down from a given scan right or left starting address.

In one embodiment, the inkjet printhead includes an internal address bus configured to be coupled to a serial bus for communicating with an electronic controller in an inkjet printing system and an internal data bus configured to be coupled to the serial bus for communicating with the electronic controller. The programmable nozzle firing order controller includes registers coupled to the internal address bus and the internal data bus. In one embodiment, the data and addresses are shared on one internal bus to save printhead die area, and signals indicate whether data or addresses are on the shared bus at a given time.

In one embodiment, the inkjet printhead includes at least a second group of nozzles and at least a second group of firing resisters. Each group of nozzles and corresponding group of firing resisters are grouped in a corresponding primitive. In one embodiment, each primitive includes a group of switches. Each switch in the group is coupled to a corresponding firing resister in the group of firing resisters and is configured to switch the electrical current through the firing resister to thereby fire the corresponding nozzle.

In one embodiment, the switches each include a field effect transistor (FET) having a gate controlled by the nozzle address. In one embodiment, the gate of each FET is also controlled by nozzle data. In one embodiment, the gate of each FET is also controlled by a fire pulse for controlling the timing of the activation of electrical current through the corresponding firing resister. In one embodiment, all FETs in a primitive are coupled between a primitive power and a primitive ground.

One aspect of the present invention provides a printhead assembly having at least one printhead. Each printhead includes a group of nozzles and a group of firing resisters corresponding to the group of nozzles. Each printhead includes a programmable nozzle firing order controller configured to provide address generator control signals. Each printhead includes a nozzle address generator configured to respond to the address generator control signals to provide a nozzle address. The nozzle address controls a sequence of which firing resister has electrical current pass through it at a given time to thereby control a firing order of the nozzles.

One embodiment of the inkjet printhead assembly includes multiple printheads.

One aspect of the present invention provides an inkjet printing system including an electronic controller configured to provide data and at least one printhead. Each printhead is configured to receive the data from the electronic controller. Each printhead includes a group of nozzles and a group of firing resisters corresponding to the group of nozzles. Each printhead includes a nozzle firing order controller configured to provide address generator control signals. The nozzle firing order controller is programmable with the data from the electronic controller. Each printhead includes a nozzle address generator configured to respond to the address generator control signals to provide a nozzle address. The nozzle address controls a sequence of which firing resister has electrical current pass through it at a given time to thereby control a firing order of the nozzles.

One embodiment of the inkjet printing system includes a serial bus for communicating data between the electronic controller and each printhead. In one embodiment, each printhead includes an internal address bus configured to be coupled to the serial bus and an internal data bus configured to be coupled to the serial bus. The programmable nozzle firing order controller includes registers coupled to the internal address bus and the internal data bus. In one embodiment, the data and addresses are shared on one internal bus.

One aspect of the present invention provides a method of generating a nozzle address in a printhead. The method includes providing address generator control signals from a programmable nozzle firing order controller in a printhead. The method includes generating a nozzle address in response to the address generator control signals. The method includes controlling, with the nozzle address, a sequence of which firing resister of a group of firing resisters has electrical current pass through it at a given time to thereby control a firing order of a group of nozzles corresponding to the group of resisters.

In one embodiment, the method includes holding, in the programmable nozzle firing order controller, a right scan starting address value representing a starting value for generating the nozzle address for printing in a right scan direction. In this embodiment, the method also includes holding, in the programmable nozzle firing order controller, a left scan starting address value representing a starting value for generating the nozzle address for printing in a left scan direction.

In one embodiment, the method includes holding, in the programmable nozzle firing order controller, control bits to control the nozzle firing order sequence provided by the nozzle address after a given scan right or left starting address. In one embodiment, the method includes holding, in the programmable nozzle firing order controller, a direction field representing a direction value to indicate a scan direction of the inkjet printhead. In one embodiment, the method includes counting up or counting down based on the direction value. In one embodiment, the method includes holding, in the programmable nozzle firing order controller, an address sequence field representing an address sequence value to control a sequence in which the nozzle address is generated from a given scan right or left starting address.

In one embodiment, the method includes programming registers in the programmable nozzle firing order controller to change the sequence of which firing resister of the group of firing resisters has electrical current pass through it at a given time to thereby program the firing order of the group of nozzles corresponding to the group of resisters.

The inkjet printhead according to the present invention includes the programmable nozzle firing order controller which can be programmed to change the nozzle firing order in the printhead. As a result, new masks do not need to be generated if a new firing order is desired. The programmable nozzle firing order permitted by the programmable nozzle firing order controller allows architects of inkjet printhead designs more freedom to experiment with different firing orders without the necessity of generating new masks and allows a single printhead die design to be employed across a wide variety of inkjet printing system products, which would otherwise require custom printhead die due to varying fire order requirements.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading,"

"trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
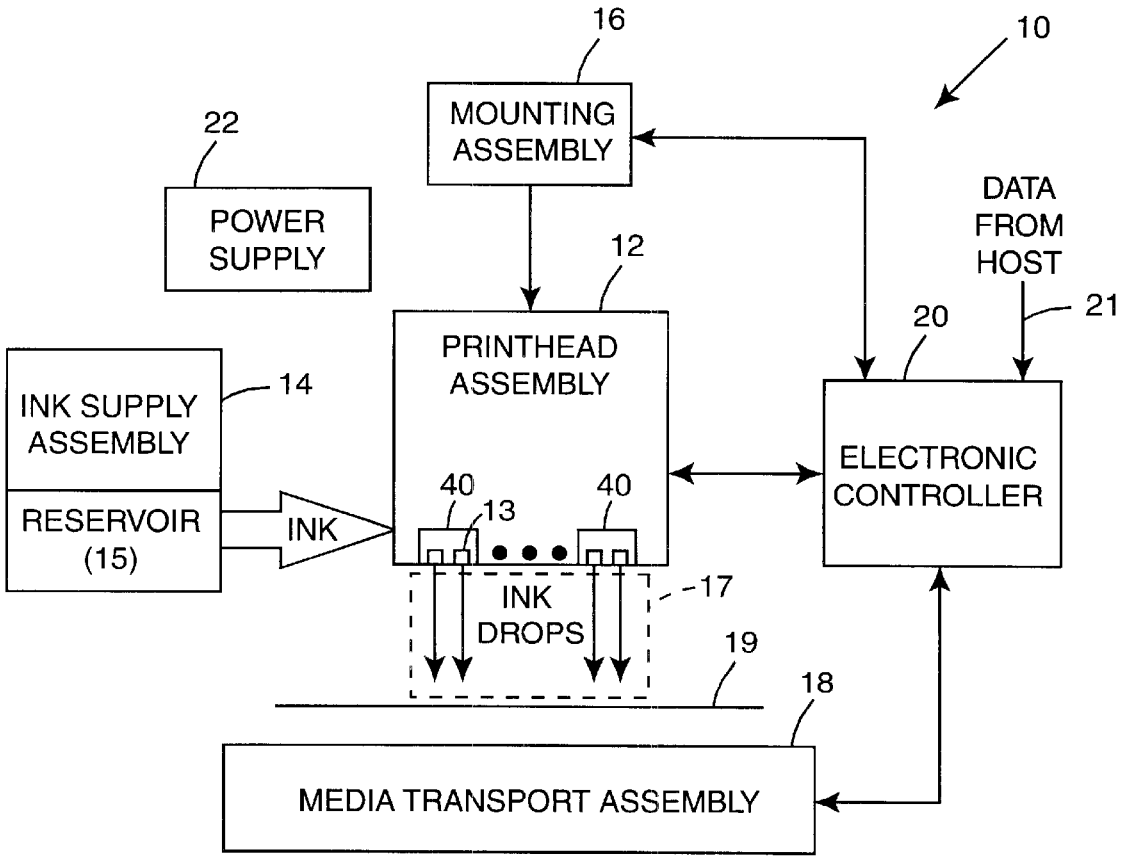
FIG. 1 is a block diagram illustrating one embodiment of an inkjet printing system.

FIG. 1 illustrates one embodiment of an inkjet printing system 10. Inkjet printing system 10 includes an inkjet printhead assembly 12, an ink supply assembly 14, a mounting assembly 16, a media transport assembly 18, and an electronic controller 20. At least one power supply 22 provides power to the various electrical components of inkjet printing system 10. Inkjet printhead assembly 12 includes at least one printhead or printhead die 40 which ejects drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, electronic controller 20 controls inkjet printhead assembly 12 for ejection of ink drops from nozzles 13. As such, electronic controller 20 defines a pattern of ejected ink drops which form characters, symbols, and/or other graphics or images on print medium 19. The pattern of ejected ink drops is determined by the print job commands and/or command parameters.

In one embodiment, inkjet printhead assembly 12 includes one printhead 40. In another embodiment, inkjet printhead assembly 12 is a wide-array or multi-head printhead assembly. In one wide-array embodiment, inkjet printhead assembly 12 includes a carrier, which carries printhead dies 40, provides electrical communication between printhead dies 40 and electronic controller 20, and provides fluidic communication between printhead dies 40 and ink supply assembly 14.

Figure 2:
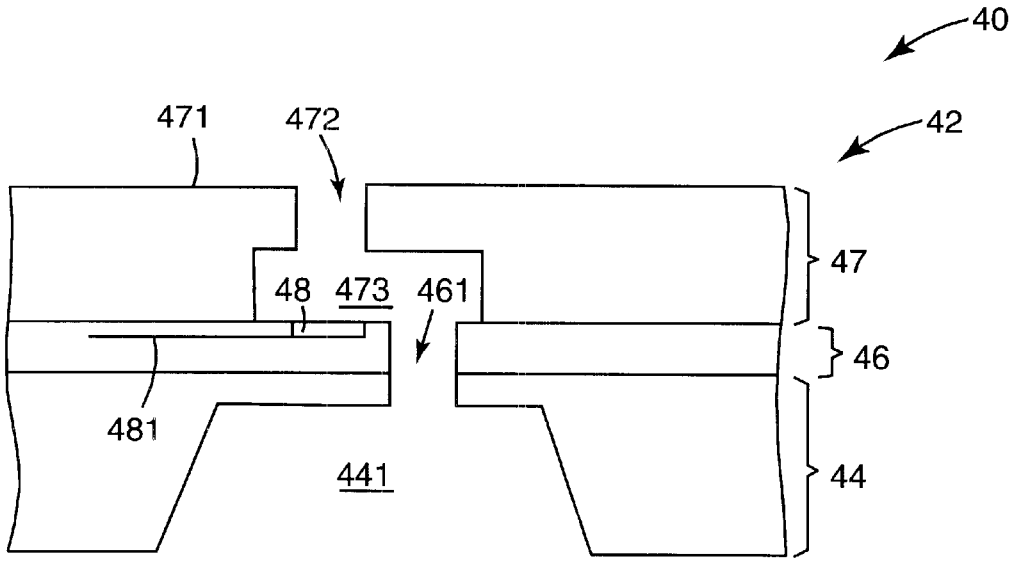
FIG. 2 is an enlarged schematic cross-sectional view illustrating portions of one embodiment of a printhead die in the printing system of FIG. 1.

A portion of one embodiment of a printhead die 40 is illustrated schematically in FIG. 2. Printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Printhead assembly 12 can include any suitable number (N) of printheads 40, where N is at least one. Before a print operation can be performed, data must be sent to printhead 40. Data includes, for example, print data and non-print data for printhead 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

Figure 3:
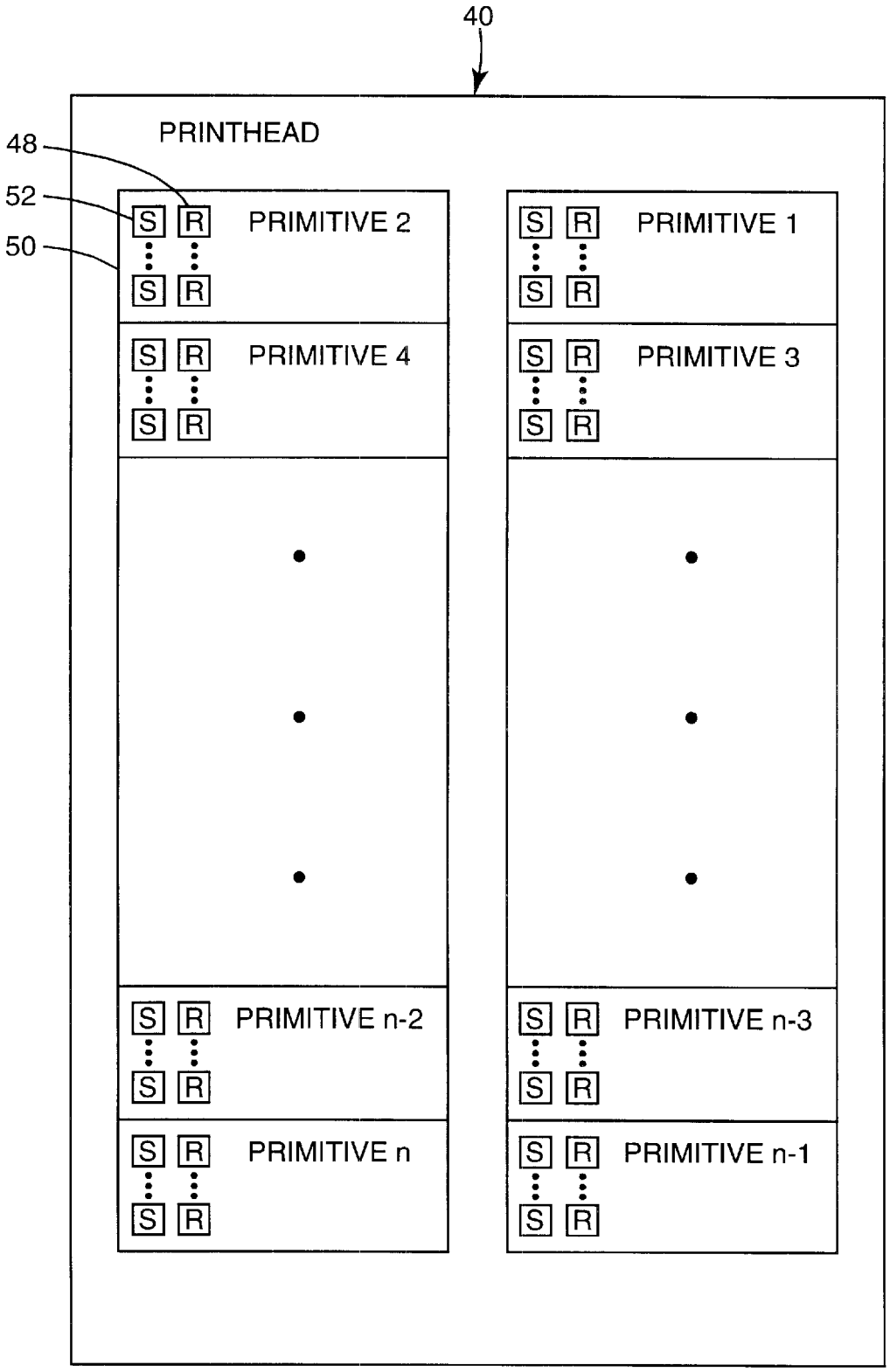
FIG. 3 is a block diagram illustrating portions of one embodiment of an inkjet printhead having firing resistors grouped together into primitives.

One embodiment of printhead 40 is illustrated generally in block diagram form in FIG. 3. Printhead 40 includes multiple firing resistors 48 which are grouped together into primitives 50. As illustrated in FIG. 3, printhead 40 includes N primitives 50. The number of firing resistors 48 grouped in a given primitive can vary from primitive to primitive or can be the same for each primitive in printhead 40. Each firing resistor 48 has an associated switching device 52, such as a field effect transistor (FET). A single power lead provides power to the source or drain of each FET 52 for each resistor in each primitive 50. Each FET 52 in a primitive 50 is controlled with a separately energizable address lead coupled to the gate of the FET 52. Each address lead is shared by multiple primitives 50. As described in detail below, the address leads are controlled so that only one FET 52 is switched on at a given time so that at most a single firing resistor 48 in a primitive 50 has electrical current passed through it to heat the ink in a corresponding selected vaporization chamber at the given time.

In the embodiment illustrated in FIG. 3, primitives 50 are arranged in printhead 40 in two columns of N/2 primitives per column. Other embodiments of printhead 40, however, have primitives arranged in many other suitable arrangements.

Figure 4:
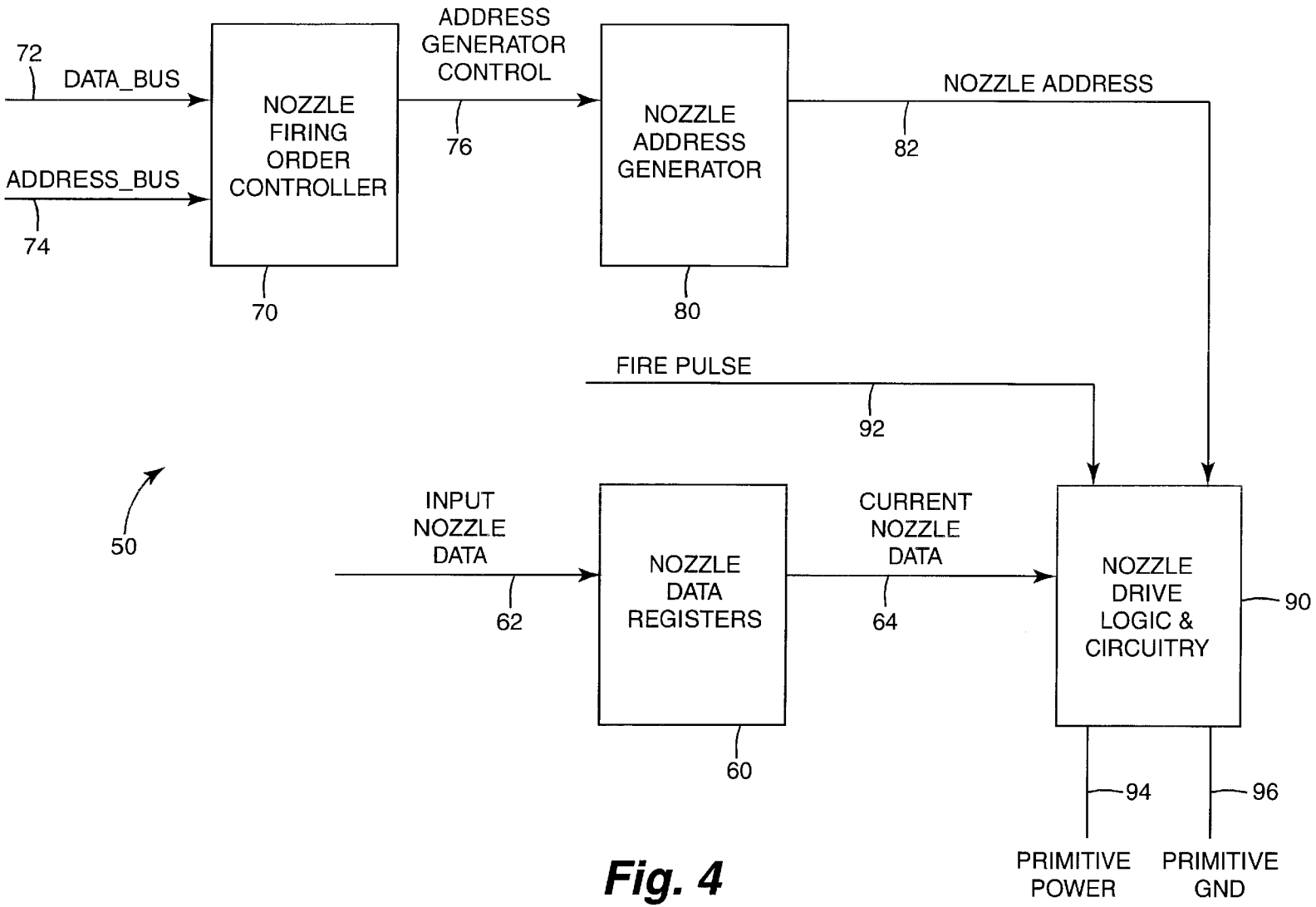
FIG. 4 is a block diagram of one embodiment of a primitive according to the present invention.

One embodiment of a primitive 50 of printhead 40 is illustrated generally in block diagram form in FIG. 4. Primitive 50 includes nozzle data registers 60 which receive input nozzle data on path 62. In one embodiment, electronic controller 20 provides the input nozzle data on a print data bus in a serial format to path 62. In one embodiment, nozzle data registers 60 are implemented as a series of registers which receive the input nozzle data on path 62 from electronic controller 20 and function to buffer, hold, and delay the input nozzle data provided on path 62. Nozzle data registers 60 provide current nozzle data on a path 64. The current nozzle data on path 64 represents the current nozzle data for controlling ejection of ink drops from the nozzles 13 of printhead 40 to cause characters or other images represented by the nozzle data to be printed upon the print medium 19.

Primitive 50 includes a nozzle firing order controller 70 having internal registers which receive data from data_bus 72 and which are addressed by addresses on address_bus 74. Data_bus 72 and address_bus 74 are internal busses in printhead 40 which address selected registers contained in printhead 40. Nozzle firing order controller 70 provides address generator control signals to a nozzle address generator 80 on a path 76. Nozzle address generator 80 provides a nozzle address on path 82. Nozzle address generator 80 cycles through the nozzle address provided on path 82 so that all nozzles can be fired but only a single firing resistor in primitive 50 is operated at a given time. The nozzle firing order controller 70 provides the address generator control signals on path 76 to control the sequence of the nozzle addresses provided on path 82 to thereby control the nozzle firing order in primitive 50.

Nozzle drive logic and circuitry 90 receives the current nozzle data on path 64, the nozzle address on path 82, and a fire pulse on a path 92. Nozzle drive logic and circuitry 90 also receives primitive power on power line 94 and primitive ground on ground line 96. Nozzle drive logic and circuitry 90 combines the current nozzle data, the nozzle address, and the fire pulse to sequentially switch electrical current from primitive power line 94 through firing resistors to ground line 96. The current nozzle data represents the characters, symbols, and/or other graphics or images to be printed. The nozzle address controls the sequence of which nozzle is to be fired at a given time (i.e., the nozzle firing order). The fire pulse controls the timing of the activation of the electrical current from a power supply external to the printhead, such as power supply 22 (shown in FIG. 1).

Figure 5:
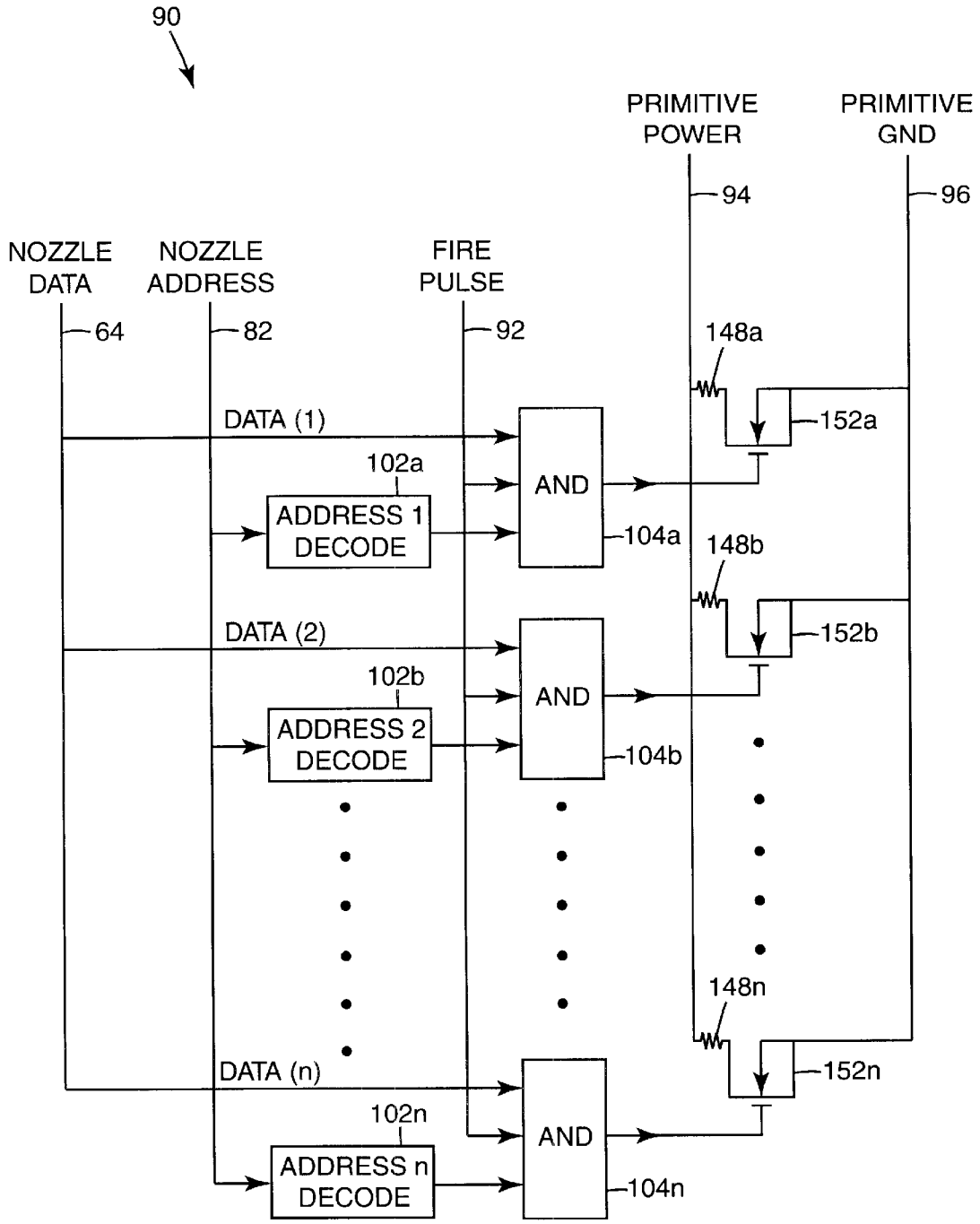
FIG. 5 is a block and schematic diagram illustrating portions of one embodiment of nozzle drive logic and circuitry employable in the primitive of FIG. 4.

Portions of one embodiment of nozzle drive logic and circuitry 90 are generally illustrated in block and schematic diagram form in FIG. 5. The portions illustrated in FIG. 5 represent the main logic and circuity for implementing the nozzle firing operation of nozzle drive logic and circuity 90. However, practical implementations of nozzle drive logic and circuitry 90 can include various other complex logic and circuitry not illustrated in FIG. 5.

In the embodiment of nozzle drive logic and circuitry 90 illustrated in FIG. 5, the nozzle address provided on path 82 is an encoded address. Thus, the nozzle address on path 82 is provided to N address decoders 102*a*, 102*b*, . . . , 102*n*. In this embodiment, the nozzle address on path 82 can represent one of N addresses representing one of N nozzles in the primitive 50. Accordingly, the address decoders respectively provide an active output signal if the nozzle address represents the nozzle associated with a given address decoder.

Nozzle drive logic and circuitry 90 includes AND gates 104*a*, 104*b*, . . . , 104*n*, which receive the N outputs from the address decoders 102*a*–102*n*. AND gates 104*a*–104*n* also respectively receive corresponding ones of the N nozzle data bits from path 64. AND gates 104*a*–104*n* also each receive the fire pulse provided on path 92. The outputs of AND gates 104*a*–104*n* are respectively coupled to corresponding control gates of FETs 152*a*–152*n*. Thus, for each AND gate 104, if the corresponding nozzle has been selected to receive data based on the nozzle data input bit from path 64, the fire pulse on line 92 is active, and the nozzle address on line 82 matches the address of the corresponding nozzle, the AND gate 104 activates its output which is coupled to the control gate of a corresponding FET 152.

Each FET 152 has its source coupled to primitive ground line 96 and its drain coupled to a corresponding firing resistor 148. Firing resistors 148*a*–148*n* are respectively coupled between primitive power line 94 and the drains of corresponding FETs 152*a*–152*n*.

Thus, when the combination of the nozzle data bit, the decoded address bit, and the fire pulse provide three active inputs to a given AND gate 104, the given AND gate 104 provides an active pulse to the control gate of the corresponding FET 152 to thereby turn on the corresponding FET 152 which correspondingly causes current to be passed from primitive power line 94 through the selected firing resistor 148 to primitive ground line 96. The electrical current being passed through the selected firing resistor 148 heats the ink in a corresponding selected vaporization chamber to cause the ink to vaporize and be ejected from the corresponding nozzle 13.

Figure 6:
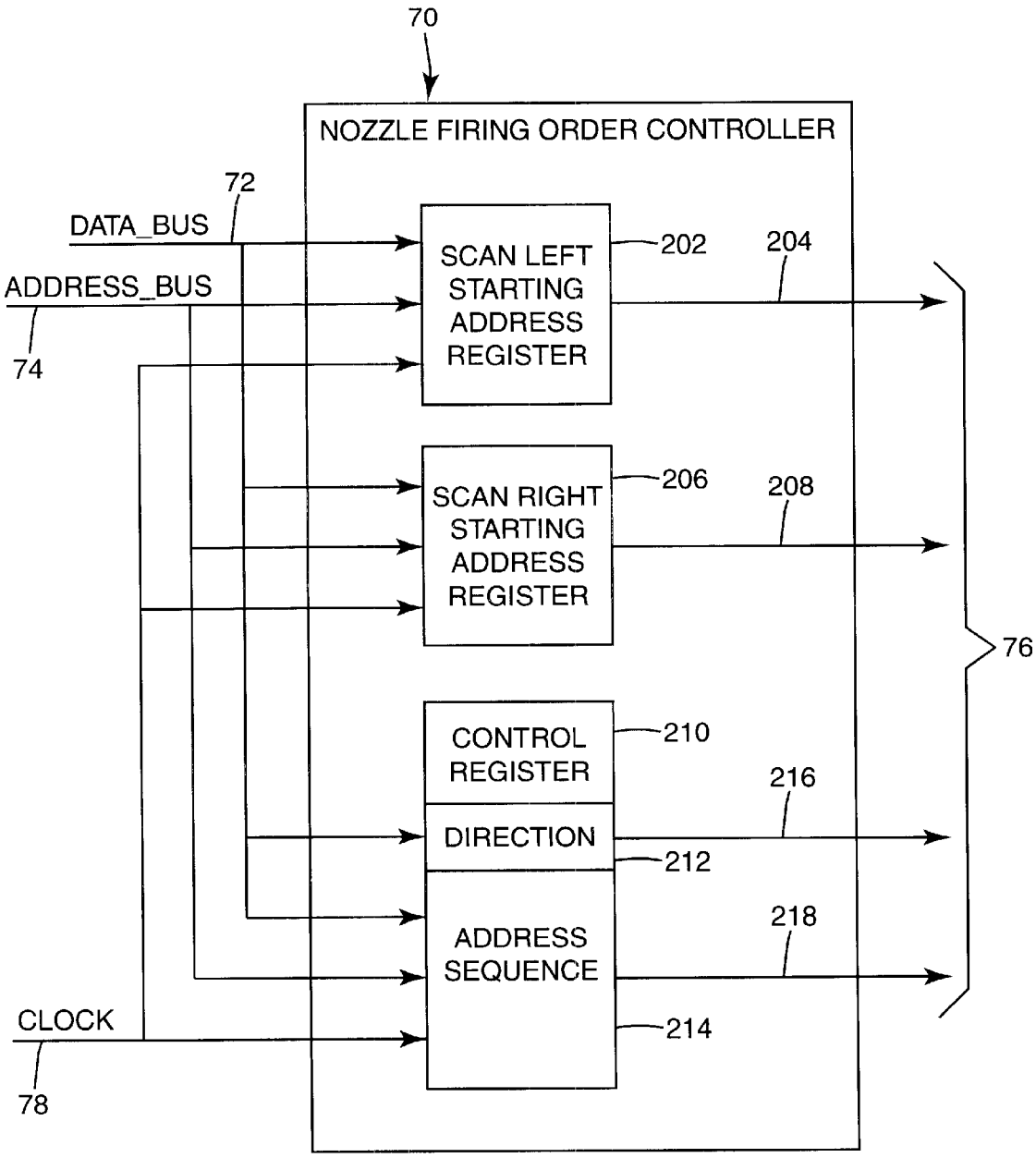
FIG. 6 is a block diagram of one embodiment of a nozzle firing order controller according to the present invention for the primitive of FIG. 4.

One embodiment of a nozzle firing order controller 70 according to the present invention is illustrated generally in block diagram form in FIG. 6. The nozzle firing order controller 70 includes a scan left starting address register 202 which provides a scan left starting address on a line 204. Nozzle firing order controller 70 includes a scan right starting address register 206 which provides a scan right starting address on a line 208. In one embodiment, the scan left starting address and the scan right starting address are stored in a shared starting address register. This embodiment saves space on the printhead die 40, but the electronic controller 20 needs to re-write the shared starting address register with each change of scanning direction.

Nozzle firing order controller 70 also includes a control register 210 which includes a direction field 212 and an address sequence field 214. Control register 210 provides a direction value represented by the direction field 212 on a line 216 and an address sequence value represented by the address sequence field 214 on a line 218.

Lines 204, 208, 216, and 218 are collectively referred to herein as path 76. Correspondingly, the scan left starting address on line 204, the scan right starting address on line 208, the direction value on line 216, and the address sequence value on line 218 are collectively referred to as the address generator control signals provided on path 76.

Scan left starting address register 202, scan right starting address register 206, and control register 210 each receive data from internal data_bus 72, receive addresses on internal address_bus 74, and are clocked by a clock signal on a clock line 78. In one embodiment, the data and addresses are shared on one internal bus to save printhead die 40 area, and signals indicate whether data or address are on the shared bus at a given time.

Electronic controller 20 of inkjet printing system 10 can access registers 202, 206, and 210 of nozzle firing order controller 70 in the same manner that electronic controller 20 accesses the other registers in printhead 40 via data_bus 72 and address_bus 74. Thus, no extra control circuitry is required to implement the registers 202, 206, and 210. In one embodiment, command data from electronic controller 20 which is independent of nozzle data is provided to and status data read from printhead 40 over a serial bi-directional non-print data serial bus. In this embodiment, electronic controller 20 can access registers 202, 206, and 210 via the bi-directional non-print data serial bus which communicates serial data to and from data_bus 72 and address_bus 74. In this way, scan left starting address register 202, scan right starting address register 206, and control register 210 are implemented as programmable registers.

In operation, a scanning printhead 40 in an inkjet printing system 10 is capable of printing in the left scan direction and the right scan direction. Thus, depending upon the scan direction of printhead 40, a separate starting address is used for the left scan direction and a separate starting address is used for the right scan direction. In the embodiment of nozzle firing order controller 70 illustrated in FIG. 6, scan left starting address register 202 holds a starting value for nozzle address generator 80 for printing in the left scan direction and scan right starting address register 206 holds a starting value for nozzle address generator 80 for printing in the right scan direction.

Scan left starting address register 202 and scan right starting address register 206 are sufficiently wide to hold the number of bits necessary to represent the addresses for each nozzle 13 within the primitive 50. In the example embodiment described below, the addresses for the nozzles are encoded into a binary count. In other suitable embodiments, the addresses are encoded into other codes, such as a gray-code. In yet another embodiment, a separate address line is provided for each nozzle within the primitive 50.

Control register 210 provides the control bits to control the nozzle firing order sequence provided by address generator 80 after the given scan left starting address or scan right starting address. Direction field 212 of control register 210 indicates to address generator 80 the direction printhead 40 is moving. In one embodiment, address generator 80 responds to the direction value provided on line 216 to either count up or count down based on whether printhead 40 is scanning in the right direction or left direction.

The address sequence field 214 in control register 210 provides the bits which control the actual sequence in which address generator 80 counts up or down from the scan right starting address or the scan left starting address.

The following is an illustrative example of one example embodiment of nozzle firing order controller 70 controlling address generator 80 to control the nozzle firing order in an example printhead 40. In this example embodiment, there are eight nozzles per primitive 50. In this example embodiment, the output of address generator 80 is an encoded 3-bit binary nozzle address. In this example embodiment, the relationship between the nozzle in primitive 50 and the encoded 3-bit binary nozzle address on an example nozzle address bus 82 is given by the following Table I.

TABLE I

| Encoded Nozzle Address | Nozzle Number |
|---|---|
| 000 | 1 |
| 001 | 2 |
| 010 | 3 |
| 011 | 4 |
| 100 | 5 |
| 101 | 6 |
| 110 | 7 |
| 111 | 8 |

In this example embodiment, scan left staring address register 202 holds a 3-bit scan left starting address value and scan right starting address register 206 holds a 3-bit scan right starting address value.

In this example embodiment, direction field 212 is one bit which represents the direction printhead 40 is moving.

In this example embodiment, the following example four address sequences fire all nozzles. Each of the following four address sequences assumes a starting address that points to nozzle 1.

SKIP0—Fire each nozzle in order: 1-2-3-4-5-6-7-8-1-2-etc.
SKIP2—Fire every third nozzle: 1-4-7-2-5-8-3-6-1-4-etc.
SKIP4—Fire every fifth nozzle: 1-6-3-8-5-2-7-4-1-6-etc.
SKIP6—Fire every seventh nozzle: 1-8-7-6-5-4-3-2-1-8-etc.

For this example embodiment, address sequences employing skip patterns other than the above four address sequences fire only a subset of all nozzles, because these other address sequences would not permit firing of every nozzle in the example primitive 50. For example, a sequence of SKIP 1 would produce a nozzle firing sequence which fires every second nozzle to yield 1-3-5-7-1-3-5-7-1-3-etc., which would fire the odd nozzles but not fire the even nozzles. However, these other skip address sequences, which fire a subset of all nozzles, are valuable for diagnostic and test purposes. Therefore, in one implementation of the example embodiment, all eight possible skip sequences are implemented.

In the example embodiment, address sequence field 214 contains two bits to be able to select each of the above four valid address sequences. In this example embodiment, address sequence field 214 is encoded to provide selection for the four possible valid address sequences. In another embodiment, a specific bit is reserved in address sequence field 214 for each possible valid sequence (e.g., four bits would be required to provide selection for the four possible valid address sequences in the example embodiment).

In the example embodiment, nozzle firing order controller 70 includes 3-bit registers 202, 206, and 210 to control the generation of all possible valid address sequences for the example address generator 80.

In one embodiment, address generator 80 is implemented with a digital state machine. Other suitable address generator 80 embodiments can be employed to provide the nozzle addresses representing the nozzle firing order.

Printhead 40 according to the present invention includes nozzle firing order controller 70 which includes programmable registers 202, 206, and 210 for controlling the nozzle firing order in printhead 40. As a result, new masks do not need to be generated if a new firing order is desired. The programmable nozzle firing order permitted by nozzle firing order controller 70 permits architects of inkjet printhead designs more freedom to experiment with different firing orders without the necessity of generating new masks. In addition, the programmable nozzle firing order provided by nozzle firing order controller 70 allows a single printhead die 40 design to be employed across a wide variety of inkjet printing system products, which would otherwise require custom printhead die 40 due to varying fire order requirements.

Presently, nozzle stagger is typically involved with firing order decisions and nozzles typically must be staggered appropriately in agreement with firing order. Nevertheless, as inkjet printing systems evolve to higher resolutions, the requirement for nozzle stagger in the nozzle columns of a printhead is reduced and possibly eliminated. Thus, in these higher resolution inkjet printing systems, any firing order can be programmed by storing the appropriate values in the programmable registers of nozzle firing order controller 70 without regard to nozzle stagger issues.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A printhead comprising:

a group of nozzles;

a group of firing resistors corresponding to the group of nozzles;

a programmable nozzle firing order controller configured to provide address generator control signals; and a nozzle address generator configured to respond to the address generator control signals to provide a nozzle address, wherein the nozzle address controls a sequence of which firing resistor has electrical current pass through it at a given time to thereby control a firing order of the nozzles.

2. The printhead of claim 1 wherein the programmable nozzle firing order controller includes:

a first scan starting address register holding a first scan starting address value representing a starting value for the nozzle address generator for printing in a first scan direction.

3. The printhead of claim 2 wherein the programmable nozzle firing order controller includes:

a second scan starting address register holding a second scan starting address value representing a starting value for the nozzle address generator for printing in a second scan direction.

4. The printhead of claim 2 wherein the first scan starting address register also holds a second starting address value representing the starting value for the nozzle address generator for printing in a second scan direction, wherein the first scan starting address register is re-written with each change of scanning direction.

5. The printhead of claim 1 wherein the programmable nozzle firing order controller includes:

a control register holding control bits to control the nozzle firing order sequence provided by the nozzle address generator after a given scan starting address.

6. The printhead of claim 1 wherein the programmable nozzle firing order controller includes:

a control register having a direction field representing a direction value to indicate to address generator a scan direction of the printhead.

7. The printhead of claim 6 wherein the nozzle address generator responds to the direction value to either count up or count down based on the direction value.

8. The printhead of claim 1 wherein the programmable nozzle firing order controller includes:

a control register having an address sequence field representing an address sequence value to control a sequence in which the nozzle address generator counts up or down from a given scan starting address.

9. The printhead of claim 1 further comprising:

at least one internal bus configured to carry data and addresses and configured to be coupled to a serial bus for communicating with an electronic controller in a printing system; and wherein the programmable nozzle firing order controller includes registers coupled to the at least one internal bus.

10. The printhead of claim 1 further comprising:

at least a second group of nozzles;

at least a second group of firing resistors, wherein each group of nozzles and corresponding group of firing resistors are grouped a corresponding primitive.

11. The printhead of claim 10, wherein each primitive further includes:

a group of switches, wherein each switch in the group is coupled to a corresponding firing resistor in the group of firing resistors and is configured to switch the electrical current through the firing resistor to thereby fire the corresponding nozzle.

12. The printhead of claim 11, wherein the switches each include a field effect transistor (FET) having a gate controlled by the nozzle address.

13. The printhead of claim 12, wherein the gate of each FET is also controlled by nozzle data.

14. The printhead of claim 12, wherein the gate of each FET is also controlled by a fire pulse for controlling the timing of the activation of electrical current through the corresponding firing resistor.

15. The printhead of claim 12, wherein all FETs in a primitive are coupled between a primitive power and a primitive ground.

16. A printhead assembly comprising:

at least one printhead, each printhead including:

a group of nozzles;

a group of firing resistors corresponding to the group of nozzles;

a programmable nozzle firing order controller configured to provide address generator control signals; and a nozzle address generator configured to respond to the address generator control signals to provide a nozzle address, wherein the nozzle address controls a sequence of which firing resistor has electrical current pass through it at a given time to thereby control a firing order of the nozzles.

17. The printhead assembly of claim 16 wherein the at least one printhead includes multiple printheads.

18. A method of generating a nozzle address in an printhead comprising:

providing address generator control signals from a programmable nozzle firing order controller in a printhead;

generating a nozzle address in response to the address generator control signals; and controlling, with the nozzle address, a sequence of which firing resistor of a group of firing resistors has electrical current pass through it at a given time to thereby control a firing order of a group of nozzles corresponding to the group of resistors.

19. The method of claim 18 further comprising:

holding, in the programmable nozzle firing order controller, a first scan starting address value representing a starting value for generating the nozzle address for printing in a first scan direction.

20. The method of claim 19 further comprising:

holding, in the programmable nozzle firing order controller, a second scan starting address value representing a starting value for generating the nozzle address for printing in a second scan direction.

21. The method of claim 18 further comprising:

holding, in the programmable nozzle firing order controller, control bits to control the nozzle firing order sequence provided by the nozzle address after a given scan starting address.

22. The method of claim 18 further comprising:

holding, in the programmable nozzle firing order controller, a direction field representing a direction value to indicate a scan direction of the printhead.

23. The method of claim 22 wherein the generating step further comprises:

counting up or counting down based on the direction value.

24. The method of claim 18 further comprising:

holding, in the programmable nozzle firing order controller, an address sequence field representing an address sequence value to control a sequence in which the nozzle address is generated from a given scan starting address.

25. The method of claim 18 further comprising:

programming registers in the programmable nozzle firing order controller to change the sequence of which firing resistor of the group of firing resistors has electrical current pass through it at a given time to thereby program the firing order of the group of nozzles corresponding to the group of resistors.

* * * * *

UNITED STATES PATENT AND TRADEMARK OFFICE

CERTIFICATE OF CORRECTION

PATENT NO. : 6,478,396 B1
DATED : November 12, 2003
INVENTOR(S) : Schloeman et al.

It is certified that error appears in the above-identified patent and that said Letters Patent is hereby corrected as shown below:

Column 13,
Line 28, delete “an” and insert in lieu thereof -- a --.

Signed and Sealed this

Fourth Day of May, 2004

JON W. DUDAS
*Acting Director of the United States Patent and Trademark Office*